US009021972B1

(12) United States Patent
Braver et al.

(10) Patent No.: US 9,021,972 B1
(45) Date of Patent: May 5, 2015

(54) UNDERDECK MID-CABIN ENTRY SYSTEM FOR MONO HULL BOAT

(71) Applicants: Skip Braver, Miami, FL (US); Hector Rodriguez, Opa Locka, FL (US); Sidney Lanier, Bradenton, FL (US)

(72) Inventors: Skip Braver, Miami, FL (US); Hector Rodriguez, Opa Locka, FL (US); Sidney Lanier, Bradenton, FL (US)

(73) Assignee: Cigarette Racing Team, LLC, Opa Locka, FL (US)

( * ) Notice: Subject to any disclaimer, the term of this patent is extended or adjusted under 35 U.S.C. 154(b) by 184 days.

(21) Appl. No.: 13/768,537

(22) Filed: Feb. 15, 2013

(51) Int. Cl.
*B63B 17/00* (2006.01)
*B63B 29/20* (2006.01)

(52) U.S. Cl.
CPC ..... *B63B 29/20* (2013.01)

(58) Field of Classification Search
USPC ..... 114/65 R, 71, 78, 343, 364, 85; D12/300, 315
See application file for complete search history.

(56) References Cited

U.S. PATENT DOCUMENTS

| | | | | |
|---|---|---|---|---|
| D246,035 | S | 10/1977 | Rudiger | |
| 4,469,040 | A | 9/1984 | Gougeon et al. | |
| D290,949 | S | 7/1987 | Scarboro | |
| 4,688,506 | A | 8/1987 | van Breems | |
| 4,729,334 | A * | 3/1988 | DeJean, Jr. | 114/255 |
| D315,892 | S | 4/1991 | Tollefson et al. | |
| D319,424 | S | 8/1991 | Marks | |
| 5,044,294 | A | 9/1991 | Kronich et al. | |
| 5,211,126 | A | 5/1993 | Johnson | |
| 5,232,385 | A | 8/1993 | Hatfield | |
| D430,098 | S | 8/2000 | Vuckovis | |
| D548,666 | S | 8/2007 | Laupman | |
| D553,071 | S | 10/2007 | De Rover | |
| D574,313 | S | 8/2008 | De Rover | |
| D587,641 | S | 3/2009 | Bouckaert | |
| 7,591,228 | B2 | 9/2009 | Hopper et al. | |
| 8,443,746 | B2 * | 5/2013 | Pegg et al. | 114/65 R |
| 2005/0087117 | A1 | 4/2005 | Scott et al. | |
| 2010/0282154 | A1 | 11/2010 | Cook et al. | |
| 2011/0197800 | A1 | 8/2011 | Kalil | |
| 2013/0055944 | A1 | 3/2013 | Poulsen | |
| 2014/0116319 | A1 | 5/2014 | Dougherty et al. | |
| 2014/0202372 | A1 | 7/2014 | De Basto et al. | |
| 2014/0216320 | A1 | 8/2014 | Lee | |

FOREIGN PATENT DOCUMENTS

| | | |
|---|---|---|
| EM 001380455-0001 | OHIM | 8/2013 |

* cited by examiner

*Primary Examiner* — Edwin Swinehart
(74) *Attorney, Agent, or Firm* — Malloy & Malloy, P.L.

(57) ABSTRACT

An under deck mid cabin entry system for a mono hull boat including an entry console and exposed top and front surfaces. Front and top openings extend to the top edge of the front surface and collectively define a generally L shaped entryway. The entry console is disposed to the side of a center console and provides access to steps extending beneath the main deck. A top step is within the entry console proximate to the front surface and the steps curve towards a central beam of the boat and descend into the mid cabin such that a bottom step proximate to a floor of the mid cabin directs a user into a central area of the mid cabin and terminates to avoid obstructing movement in the central area.

20 Claims, 6 Drawing Sheets

UNDERDECK MID-CABIN ENTRY SYSTEM FOR MONO HULL BOAT

BACKGROUND OF THE INVENTION

1. Field of the Invention

The present invention relates to an underdeck mid-cabin entry system for a mono hull boat which preserves and maximizes the largest amount of underdeck cabin space possible, while still providing convenient access to the mid-cabin.

2. Description of the Related Art

In the field of art related to the design of cabins under the main deck of mid-sized mono hull boats, usable cabin space is typically at a premium, especially given the limited distance from the underside of the main deck to the boat hull. Mono hull type boats can include v-hull and step hull boats, and typically will be in the range of twenty or less feet in beam or width. As a result, the depth of the hull in a mono hull boat is generally limited based upon an acceptable slope of the hull itself. A predominant feature of mono hull boats is also the inclusion of a center console. Specifically, in order to maintain balance and symmetry a large center console is provided as part of the main deck, the center console being the location where the controls, gages and steering of the boat are achieved by an operator on the open deck. Moreover, as such mono hull boats typically have seating areas both in front of and behind the center console, passages are traditionally provided on both sides of the center console so as to achieve a 360 degree walk around possibility, a significant requirement in the fishing environment for which the traditional center console boat was designed. Therefore, in order to maximize the functionality of the mid cabin, the center console has traditionally included an entry hatch, in either a side or the front end opposite the controls, through which stairs descending into the mid cabin are accessed. In this way added head room is provided as the user is descending into the mid cabin and a central area of the mid cabin is given the maximum headroom by the center console. Of course, once in the mid cabin a variety of internal configurations are presented so as to maximize the use of the space including often positioning compact lavatories and other storage areas, with the space beneath the stairs that descend down from the center console providing a further storage location and/or a cramped functional area.

As can be appreciated, the maximum height of the mid-cabin is located at the central area, and therefore the requirement of the access stairs extending into and through a portion of that central area significantly diminishes and detracts from the usable, maximum height area, requiring that the less comfortable side spaces be the primary areas that define the mid cabin. As a result it would be highly beneficial to provide an improved entry system that allows the maximum preservation of the central cabin area as usable space for a variety of functional purposes including the installation of a full or max height lavatory and/or greater ease of movement and maneuvering within the mid-cabin. Further, such a system should still provide entry ease to a user and should allow a generally upright entry into the main central cabin areas.

SUMMARY OF THE INVENTION

The present invention relates to an under deck mid-cabin entry system. In particular the under deck mid-cabin entry system is specifically designed for use and installation on a mono hull boat which has a main deck with opposite edges that engage an interior of the hull. Furthermore, the mono hull boat is preferably of a mid size, such as less than approximately 50-55 feet in length.

The entry system of the present invention includes an entry console. This entry console preferably has at least an exposed top surface and an exposed front surface. Moreover, the entry console preferably extends upward from an upper surface of the main deck, thereby being confrontable by a user walking on the main deck of the boat.

Defined in the exposed front surface of the entry console is a front opening. This front opening preferably extends up to a top edge of the front surface of the entry console, and can preferably occupy a majority of the width of the front surface. Also defined in the entry console, and in particular in the top surface of the entry console is a top opening. This top opening extends through the top surface of the entry console and continues to the top edge of the front surface. In this manner, both the top opening and front opening collectively define a continuous generally L-shaped entry way when not covered or obstructed.

The entry console is preferably defined by an elevated generally squared or cube type of configuration, and is positioned on the main deck in close proximity to one of the opposite edges of the main deck. As a result, the entry console overlies generally the upper sloped portion of the bottom area of the boat hull, and in the preferred embodiments is to the side of the center console.

Secured in generally adjacent and/or proximate position relative to the L-shaped entry way are a plurality of steps. The plurality of steps preferably extend beneath the main deck commencing with a top step disposed in close proximity to the main deck within an interior of the entry console that is generally proximate to the front surface of the console. As a result, the front surface of the entry console and a top of the steps generally define a threshold for a user desiring to access and descend the plurality of steps.

The plurality of steps extend downwardly from the top step and preferably somewhat gradually curve towards a central beam of the mono hull boat as they descend into the main cabin. In this regard a bottom one of the steps is disposed in generally proximate relation to a floor of the mid-cabin so that a user can step off of the bottom step onto the floor of the mid-cabin. Moreover, the bottom one of the steps is preferably oriented towards the central beam so as to direct the user of the steps into the central area of the mid-cabin. Further, the bottom step preferably does not enter the central area of the mid-cabin itself, thereby avoiding obstructing movement within the central area of the mid-cabin and ensuring that the plurality of steps do not occupy the central area of the mid cabin. In this manner, the functionality and height of the central area is preserved and not diminished by the steps, enabling its use for a variety of purposes including, for example, a centrally positioned, maximum height lavatory beneath the main deck.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
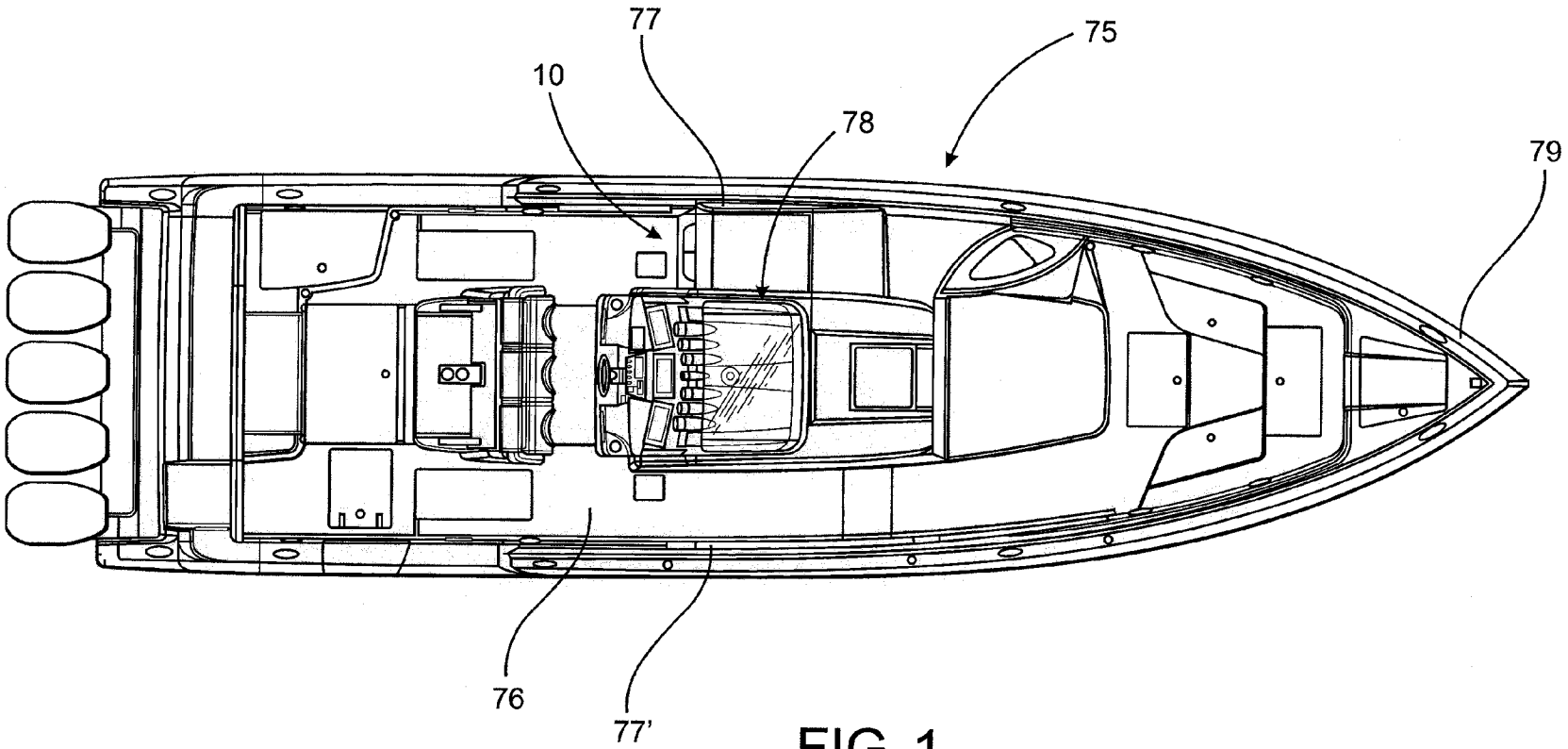
FIG. 1 is a top plan view of a mono hull boat embodying the entry system of the present invention.
Figure 2:
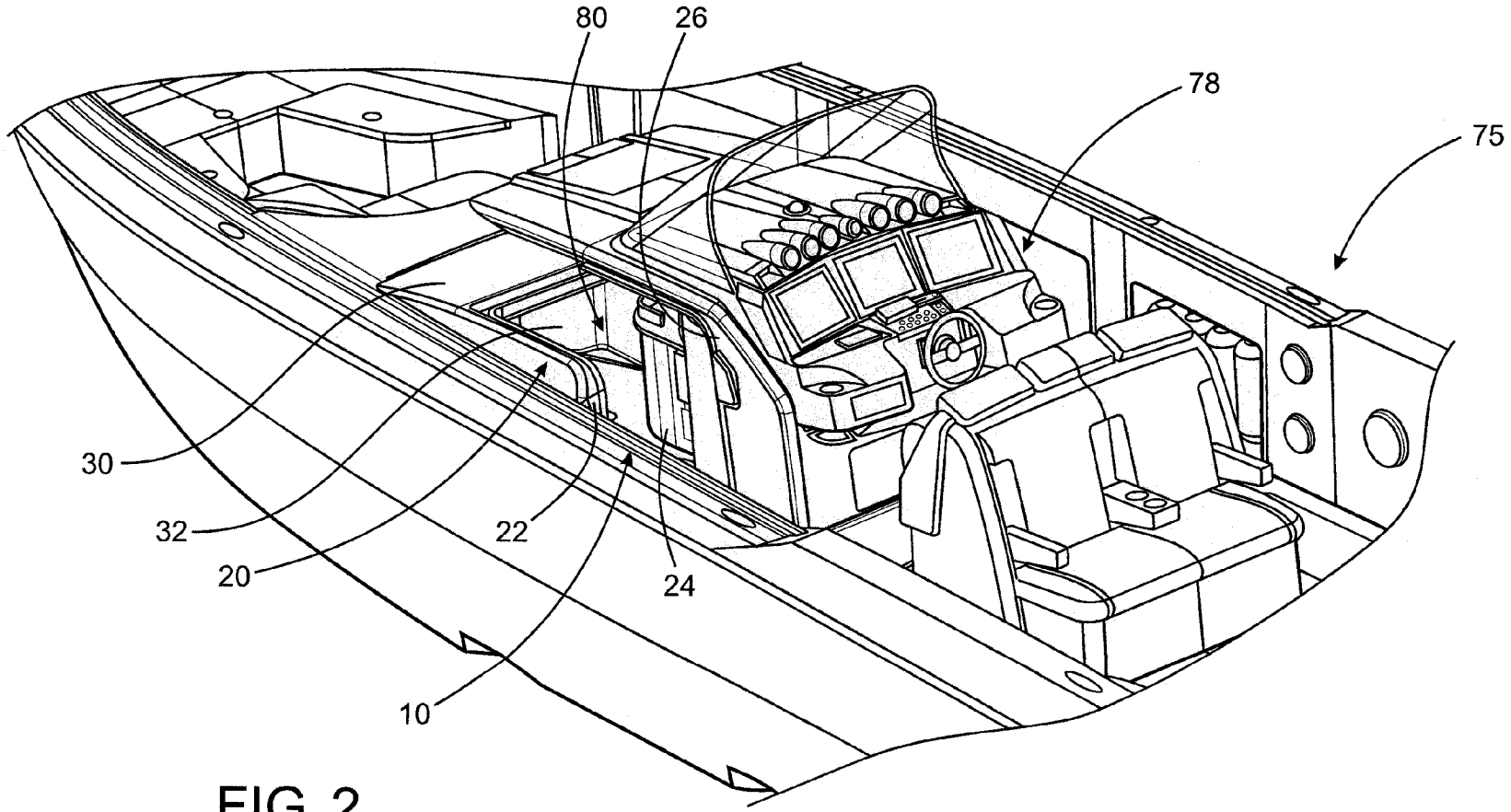
FIG. 2 is a perspective view of the entry system of the present invention illustrating the entry console in an open configuration.

As referenced in the attached Figures the present invention generally relates to an underdeck mid-cabin entry system, generally indicated as 10. In particular, the entry system 10 is especially configured for use on mono hull boats 75 which include a main deck 76 and an underdeck mid-cabin 80. In the preferred embodiment of the present invention the entry system 10 is configured for mid to smaller sized mono hull boats having a beam or width of less than 17 to 20 feet, such as, for example, as what might facilitate transport on a trailer if necessary, and of an overall length of typically less than 50-55 feet, and in a preferred embodiment at 42 feet. Naturally trailer transport is not a requirement of the boat type on which the present entry system 10 will be utilized.

Furthermore, the mono hull boat 10 preferably includes one of a plurality of traditional style mono hulls 90, such as a step hull, or a v-hull. This type of mono hull 90 is generally formed of a single piece of material and naturally has at its lowest point a central beam 91 that slopes upwardly to opposite perimeter edges 92 of a lower portion of the hull 90 which are generally at the highest point and/or at a minimum a higher point than the central lowest point 91. In some embodiments, hull 90 can also extend upward from the sloped bottom portion until it engages what is typically a single piece main deck 76. Furthermore, in the preferred embodiment, the mono hull boat 75 also includes a center console 78. In particular, the center console 78 is preferably at least partially integrally formed with the main deck 76 and includes the navigation and control equipment for the boat 75. As such, the center console 78 generally defines an elevated central structure that extends above the main deck 76, and is preferably aligned above a central area 82 of the mid-cabin 80. As a result, the center console 78 helps to define a maximum height area of the mid-cabin 80.

Looking to the mid-cabin 80, it is configured to achieve a functional covered space for users of the boat, and as a result, can include sleeping accommodations, lounge, eating, and/or sitting accommodations, storage and/or entertainment facilities, and/or a lavatory 86. In connection with the preferred embodiment of the present invention, the lavatory 86 is preferably located in the central area 82 of the mid cabin 80 beneath the center console 78 so as to take advantage of the maximum height area for comfortable and convenient lavatory 86 usage. Likewise, having a maximum height central area 82 provides users maneuverability while they are using and/or moving into the various accommodations and facilities located within the mid cabin.

Turning to the entry system 10 of the present invention, it preferably includes an entry console 20. In particular the entry console 20 preferably includes an elevated and/or cubed configuration that extends above the main deck 76 of the boat 75. In this regard, in a preferred embodiment the entry console 20 may have a matched height relative to the center console 78 of the boat so as to achieve uniformity in style and height. Moreover, similar to the main console, the entry console 20 may be integrally formed with the main deck 76 and/or may be continuous with the center console. Along these lines, the entry console 20 is disposed on the main deck 76 in a generally close proximity to one of the opposite side edges 77, 77' of the main deck 76. Further, in a preferred embodiment wherein the beam or width of the boat at a position of the entry console 20 is less than approximately 17 feet, the entry console 20 is preferably disposed flush with an interior side wall of the boat, or at a minimum within approximately 2½ feet of the side edge 77 of the main deck 76 along which it is positioned. In this regard and as illustrated in the Figures, the entry console 20 preferably, but not necessarily, occupies the entire gap between the center console 78 of the boat 75 and the corresponding side edge 77 or 77' of the main deck 76 and the boat itself 75.

Looking in further detail to the entry console 20, it includes a front surface 22, and a top surface, generally 30. The front surface 22 includes a front opening 24 defined therein, the front opening 24 preferably extending from at or slightly above the walking surface of the main deck 76 up to the top edge 26 of the front surface 22. As a result, the front opening 24 defines a complete opening up through the top of the entry console 20. Similarly, in order to facilitate passage of a user therethrough, the front opening 24 preferably has a width sufficient to accommodate passage of a person, that width optimally occupying all or a majority of the front surface 22.

Similarly the top surface 30 of the entry console 20 includes a top opening 32. The top opening 32 extends through the top surface 30, also to the top edge 26 of the front surface 22. As a result, the top opening 32 and front opening 24 cooperatively define a generally L-shaped entry way as seen in the Figures. As also seen in the figures, the width of the top opening 32 preferably corresponds to the width of the front opening 24, and the overall length of the top opening 32 can vary. In the preferred embodiment, however, the top opening 32 extends from the front surface 22 approximately two to four feet so as to define an open area to allow for ease of passage by a user into the entry console 20 as will be described.

Figure 5:
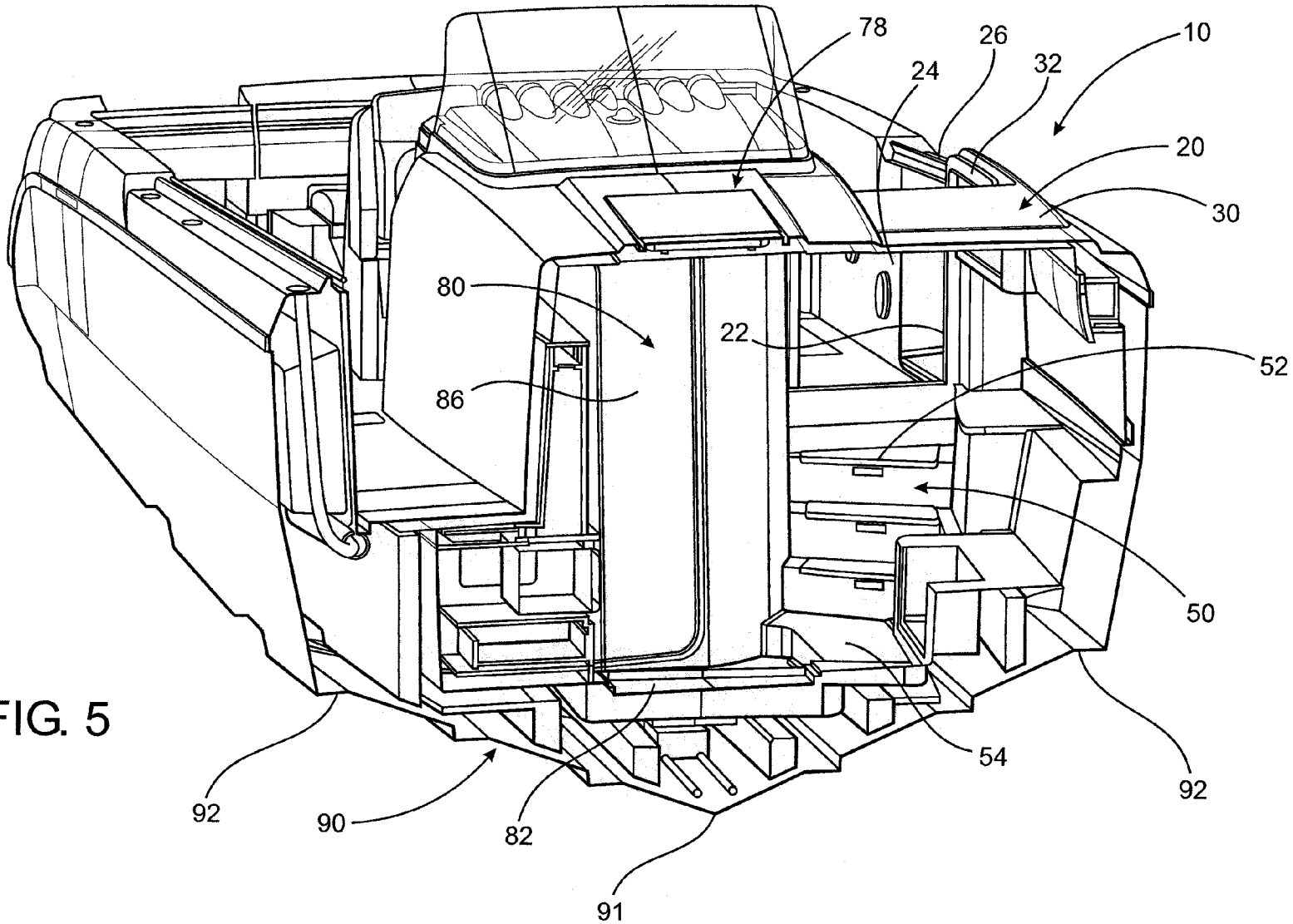
FIG. 5 is a lateral cross section of the mono hull boat illustrating an interior view of the entry system of the present invention.

Disposed just beyond the front surface 22 of the entry console 20 are a plurality of steps, generally 50. These steps 50 descend into the mid-cabin 80 of the boat 75 to provide access thereto. As seen in FIG. 5, a top step 52 of the plurality of steps 50 is preferably disposed in substantially close proximity to the main deck 76 and the front surface 22 of the entry console 20. As a result, the front surface 22 of the entry console 20 effectively defines a threshold beyond which a user will step in order to engage the top step 52. Along these lines, the top step 52 may be directly even with the main deck 76 and/or may be slightly above or below the main deck 76 so as to provide more convenient access by a user. Further, because of the open configuration of the top opening 32 defined in the top surface 30 of the entry console 20, when a user stands on the top most step 52 there head will generally protrude through the top opening 32 allowing some descending onto lower steps before their head goes below the top surface 30 of the entry console 20, and ultimately the top surface of the center console 78 of the boat 75.

As indicated in the Figures a plurality of steps 50 are shown, the exact number of the steps varying depending upon the needs and/or desired configuration and depth of the mid cabin. Nevertheless, as illustrated, the plurality of steps 50 preferably commence being oriented along a length of the boat 75 and subsequently curve toward a central beam 91 of the boat 75 as they descend into the mid-cabin 80. In a preferred embodiment at least a front edge of the steps 50 curve 30 to 45 degrees from parallel with said front surface 22, with a front edge of the bottom step possibly rotating closer to ninety degrees. As a result of this curving of the steps 50, when a user reaches a bottom step 54 they are generally directed toward a central beam 91 of the boat 70 and into the central area 82 of the mid-cabin 80 where the greatest height and maneuverability is achieved. Furthermore, the plurality of stairs 50 do not extend into the central area 82 of the mid-cabin 80 such that the underdeck volume occupied by the plurality of steps 50 remains to the side of the central area 82 and does not detract from the functionality of the maximum height central area 82 of the mid-deck 80. In this regard a convenience feature such as a lavatory 86 can be included more effectively in the central area 82 of the mid-cabin 80 without compromising height and/or detracting from other usable space of the central area 82 such as in a bedroom or relaxation area usage of the mid-cabin 80, and the functional standing area of the central area 82 is maximized.

Figure 6:
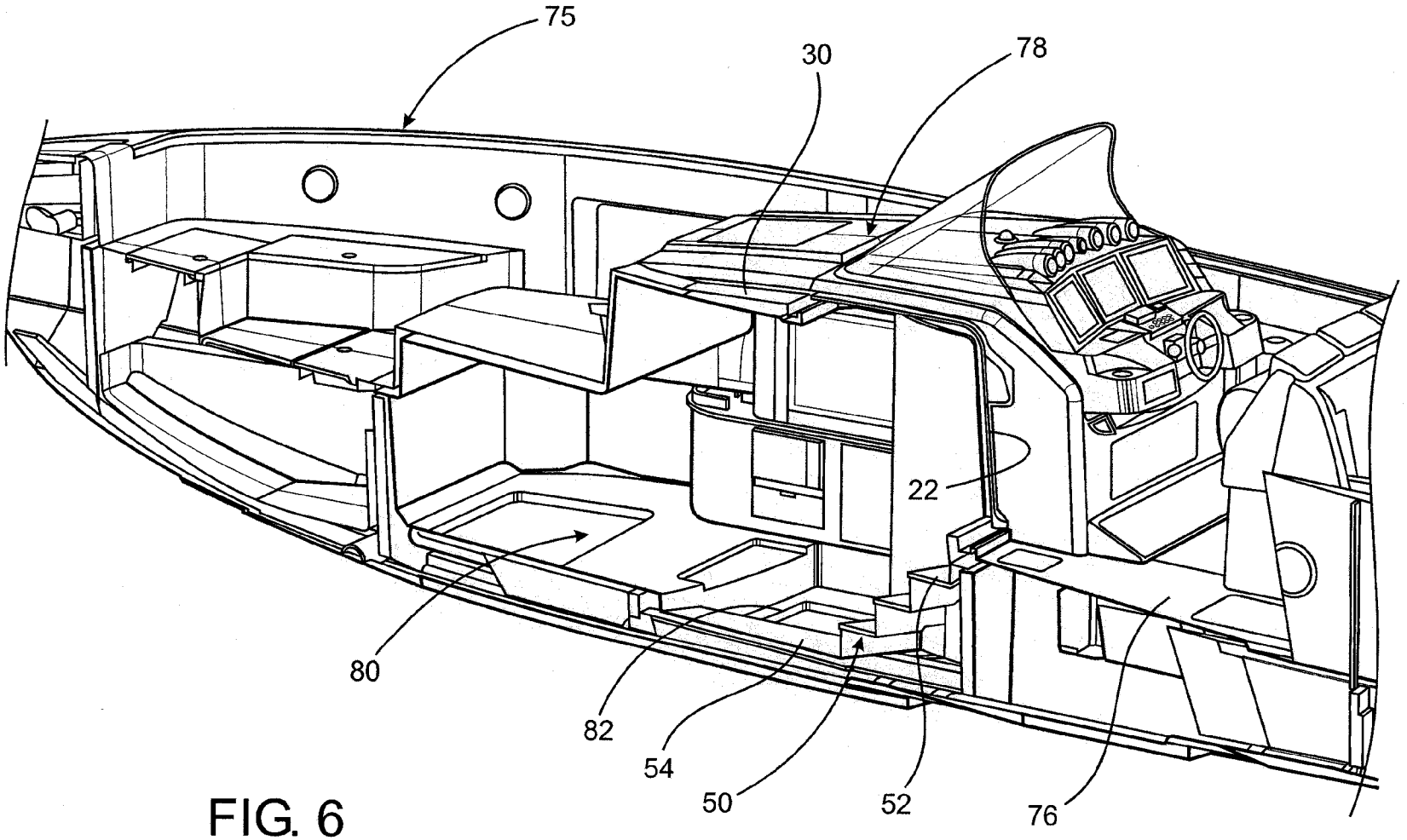
FIG. 6 is a longitudinal cross section of the mono hull boat illustrating the mid-cabin and the inter-relation between the entry system and the mid-cabin.

Looking in further detail to the bottom step 54 of the plurality of steps 50, it may define a bottom landing which in some embodiments may be larger than the remaining of the plurality of steps 50. This bottom landing 54 type of configuration provides an area where a user is able to stand prior to their final step into the central area 82 of the mid-cabin 80. In this regard, in some embodiments a tall individual standing on the landing 54 may still be partially protruding through the top opening 32 in the entry console 20. Additionally, this landing 54 may extend into the mid-cabin 80 as it may provide a region where a user sitting within the mid-cabin 80 can position their feet and indeed may extend along the length of the mid-cabin 80 either at the same level as the central area 82 or in a preferred embodiment at slightly above the central area 82 of the mid-cabin 80 so as to provide the ability to position the central area 82 at the lower most portion possible relative to the configuration of the hull 90. Accordingly, it is preferred that the landing 54 terminate prior to an entry of the lavatory 86 so as to allow the lavatory 86 to achieve maximum height, however, it also being noted that in addition to allowing for the provision of a full height lavatory 86 by maintaining the landing out from the central area 82 of the mid-cabin 80 a substantial usable area, as best illustrated in FIG. 6, can be maintained where users of the mid-cabin 80 are able to walk around comfortably and only side storage, utility and/or seating areas are compromised by decreasing height capacity that is necessitated by the curvature of the hull 90.

Figure 3:
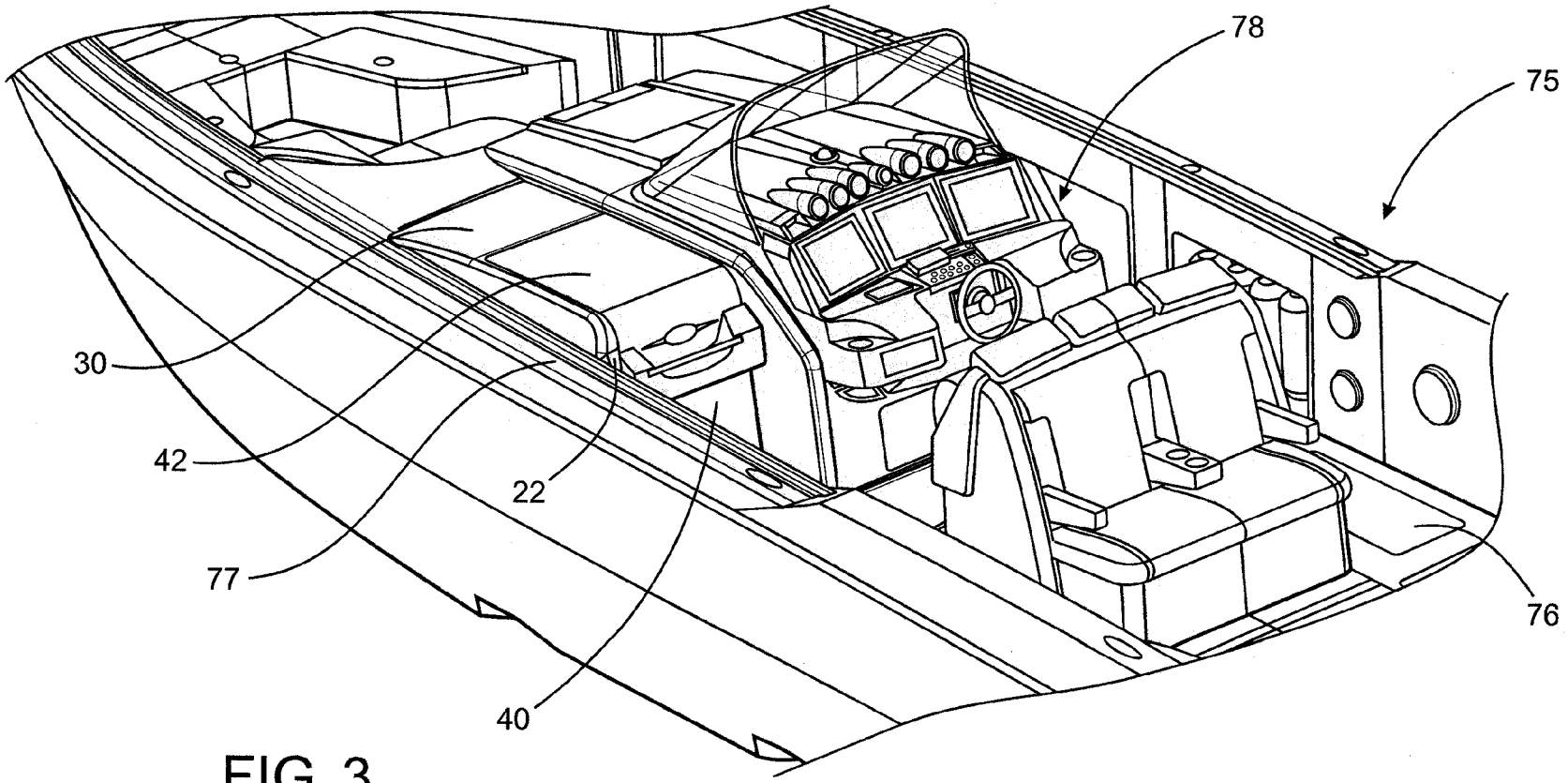
FIG. 3 is a perspective view of the entry system of the present invention illustrating the entry console in a closed orientation
Figure 4:
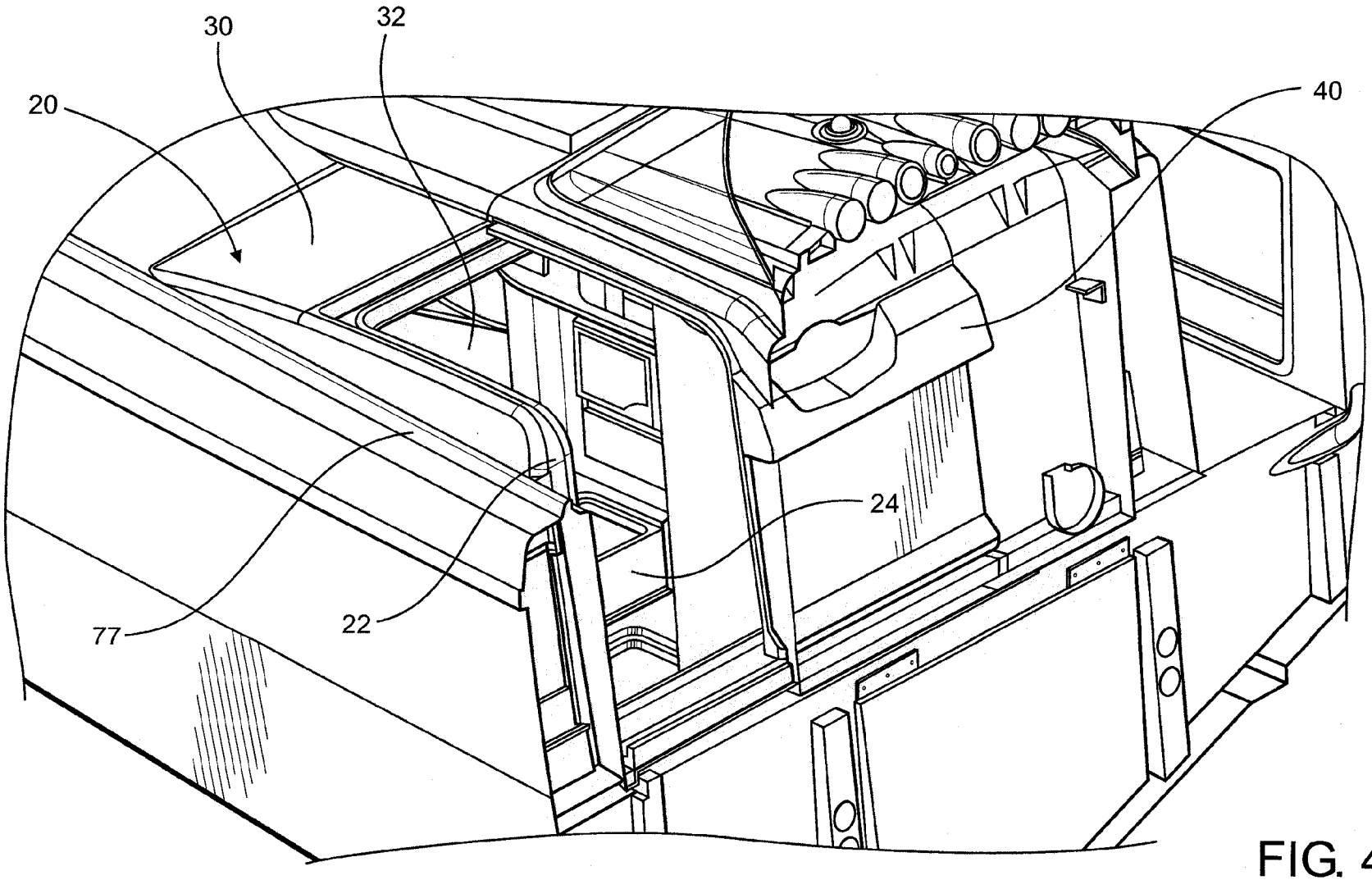
FIG. 4 is a partial, close up view of the entry console of the present invention in an open configuration.

As noted, the entry console 20 is preferably somewhat uniform and/or continuous from the central console 78 of the boat 75. Along these lines, as noted, the entry console 20 may be integrally formed with the main deck 76. Additionally, one or more entry covers 40, 42 may also be provided. In particular, a front entry cover 40 is preferably provided to cover the front surface 22 of the entry console 20 thereby concealing and closing the front opening 24. In one preferred embodiment, as seen in FIG. 4, the front entry cover 40 slides laterally out from in front of the front opening 24. Alternately, the front entry cover 40 can retract downwardly towards the main deck 76 of the boat 75. This downward retraction of the front entry cover 40, and even the lateral retraction if desired, can be achieved by a rolling configuration if the front entry cover 40 has an at least partially flexible or rollable construction and/or may simply be achieved by sliding the front entry cover 40 into a storage compartment. As yet another embodiment the front entry cover 40 can pivot down towards a rear of the boat onto the main deck 76 so as to define a step platform onto which a user may stand. Likewise the top entry cover 22 is preferably provided to retract from its covering position over the top opening 32, which in the preferred embodiment retracts towards a front 79 of the boat 75, such as by rolling or sliding into or onto a remaining portion of the top surface 30 of the entry console 20. In this regard, and as seen in FIG. 3, the top surface of the entry console 20 preferably extends well beyond the top opening 32 and can also provide functional areas for users on the main deck 76 of the boat as well as beneath the main deck.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. For use on a mono hull boat having a main deck with opposite side edges generally engaging an interior of the hull, an under deck mid cabin entry system comprising:

(a) an entry console, said entry console having at least an exposed top surface and an exposed front surface, said entry console extending upward from an upper surface of the main deck;

(b) a front opening defined in said front surface of said entry console and extending up to a top edge of said front surface;

(c) a top opening defined in said top surface of said entry console and extending to said top edge of said front surface, said top opening and said front opening defining a generally L shaped entryway;

(d) said entry console disposed on the main deck in close proximity to one of the opposite side edges of the main deck;

(e) a plurality of steps disposed beneath the main deck, a top one of said steps disposed in close proximity to the main deck and disposed in an interior of said entry console generally proximate to said front surface of said entry console;

(f) said plurality of steps rotating towards a central beam of the mono hull boat as said stairs descend into the mid cabin; and (g) a bottom one of said steps disposed in generally proximate relation to a floor of the mid cabin and angled towards the central beam so as to direct a user into a central area of the mid cabin, said bottom step terminating prior to the central area of the mid cabin so as to avoid obstructing movement in the central area of the mid cabin and such that said plurality of steps do not occupy the central area of the mid cabin.

2. An entry system as recited in claim 1 wherein said entry console is disposed adjacent a center console of the boat.

3. An entry system as recited in claim 1 wherein a width of the boat at a position of said entry console is less than 17 feet and said entry console is disposed within 2.5 feet of the side edge of the deck.

4. An entry system as recited in claim 1 wherein said entry console is integrally molded with the deck.

5. An entry system as recited in claim 1 wherein said entry console is disposed adjacent a center console of the boat and said bottom one of said steps is disposed to direct the user beneath the center console.

6. An entry system as recited in claim 1 further comprising a front entry cover movably disposed to cover said front opening in said front surface of said entry console.

7. An entry system as recited in claim 6 wherein said front entry cover retracts laterally to expose said front opening.

8. An entry system as recited in claim 1 further comprising a top entry cover movably disposed to cover said top opening in said top surface of said entry console.

9. An entry system as recited in claim 8 wherein said top entry cover retracts towards a front of the boat to expose said top opening.

10. An entry system as recited in claim 1 wherein said bottom step is larger than said remaining steps and further defines a landing platform within the mid cabin.

11. An entry system as recited in claim 10 wherein said landing terminates prior to a vertical plane of a door of a centrally positioned lavatory disposed in the mid cabin.

12. An entry system as recited in claim 1 wherein a front edge of said steps angle until at least 20 degrees from parallel to said front surface at said bottom step.

13. A mono hull boat comprising:

(a) a main deck and a hull, said main deck secured on said hull;

(b) a center console defined in a central portion of said main deck and disposed between opposite side edges of said main deck, said center console protruding upwardly above a walking surface of said main deck;

(c) an entry console disposed on said main deck, said entry console having at least an exposed top surface and an exposed front surface, (d) said entry console extending upward from said walking surface of said main deck, disposed at least partially adjacent said center console and extending from said center console to one of said opposite side edges of said main deck;

(e) a front opening defined in said front surface of said entry console and extending up to a top edge of said front surface;

(f) a top opening defined in said top surface of said entry console and extending to said top edge of said front surface, said top opening and said front opening defining a generally L shaped entryway;

(g) a mid cabin defined between said main deck and said hull; said mid cabin including a central area defined generally beneath said center console and over a central beam of said hull;

(h) a plurality of steps extending downwardly from said main deck into said mid cabin, a top one of said steps disposed in close proximity to said main deck and disposed in an interior of said entry console generally proximate to said front surface of said entry console;

(i) said plurality of steps rotating towards said central area of said mid cabin as said stairs descend into the mid cabin; and (j) a bottom one of said steps disposed in generally proximate relation to a floor of said central area of said mid cabin and angled towards said central beam so as to direct a user into said central area of said mid cabin, said bottom step terminating prior to said central area of said mid cabin so as to avoid obstructing movement in said central area of said mid cabin and such that said plurality of steps do not occupy said central area of said mid cabin.

14. A mono hull boat as recited in claim 13 further comprising a lavatory in said central area of said mid cabin.

15. A mono hull boat as recited in claim 13 wherein a width of said main deck at a position of said entry console is less than 17 feet.

16. A mono hull boat as recited in claim 13 wherein said entry console is integrally molded with said deck.

17. A mono hull boat as recited in claim 13 further comprising a front entry cover movably disposed to cover said front opening in said front surface of said entry console when in a closed orientation and to be confrontingly positioned in front of said center console when in an open position.

18. A mono hull boat as recited in claim 17 further comprising a top entry cover movably disposed to cover said top opening in said top surface of said entry console.

19. A mono hull boat as recited in claim 13 wherein said bottom step is larger than said remaining steps and further defines a landing platform within said mid cabin.

20. A mono hull boat as recited in claim 13 wherein a front edge of said steps angle until at least 20 degrees from parallel to said front surface at said bottom step.

* * * * *